United States Patent [19]

Laramie

[11] Patent Number: 4,619,398

[45] Date of Patent: Oct. 28, 1986

[54] CLOSER AND SEALER, EMPLOYING CHANNEL AND PARALLEL ALIGNING MEMBER, FOR GABLE-TOPPED FOOD CARTONS

[76] Inventor: Leon Laramie, P.O. Box 3493, Redwood City, Calif. 94064

[21] Appl. No.: 781,508

[22] Filed: Sep. 30, 1985

[51] Int. Cl.[4] ..... B65D 45/16

[52] U.S. Cl. ..... 229/17 G; 220/94 R; 229/45 R

[58] Field of Search ..... 229/17 G, 45 R, 47, 229/52 A; 220/94 R, 345; 24/30.5 R, 30.5 L

[56] References Cited

U.S. PATENT DOCUMENTS

| | | | |
|---|---|---|---|
| 2,336,503 | 12/1943 | Ringler | 229/17 G |
| 2,533,539 | 12/1950 | Vivian | 24/30.5 R |
| 2,629,916 | 3/1955 | Footlick | 24/30.5 R |
| 2,810,503 | 10/1957 | Krueger | 220/94 R |
| 3,056,622 | 10/1962 | Hilderbrandt et al. | 220/94 R |
| 3,086,264 | 4/1963 | Tindall | 24/30.5 R |
| 3,217,967 | 11/1965 | Jackson | 229/17 G |
| 3,381,883 | 5/1968 | Harris | 229/17 G |
| 3,458,110 | 7/1969 | Goldman | 229/17 G |
| 3,693,864 | 9/1972 | Wilkins | 229/17 G |

FOREIGN PATENT DOCUMENTS

| | | | |
|---|---|---|---|
| 3004908 | 9/1980 | Fed. Rep. of Germany | 229/52 A |
| 81458 | 3/1952 | Norway | 229/52 A |

*Primary Examiner*—William Price
*Assistant Examiner*—Gary E. Elkins
*Attorney, Agent, or Firm*—David Pressman

[57] ABSTRACT

A closer and sealer for gable-topped cartons (10) of the type for holding milk and other pourable liquid and solid foods comprises a device (12) having an upper channel portion (20), a lower arm portion (22) parallel to the channel portion, and a bight portion (24) interconnecting the channel and arm portions. To use the closer after decanting food from the carton, the carton is closed by folding its integral, fold-out pouring spout back in the usual manner and squeezing together and holding the uppermost multi-layered vertical gable flaps (18) of the carton. Then channel portion of the sealer and closer is fit over and slided onto the gable flaps so as to hold them together. The sealer is slided onto the flaps until the bight portion contacts the flaps and limits travel of the sealer. The lower arm portion fits into the gable recess (16) under the flaps to guide the sealer during installation onto the carton. The upper edges of the arm portion are chamfered (36) to face the sloping inside edges of the gable recess. The channel has two pairs of facing ridges, upper (26) and lower (28), to compress and hold the flap layers together; the upper pair of ridges are more closely spaced to accommodate the narrower upper portion of the flap.

11 Claims, 7 Drawing Figures

CLOSER AND SEALER, EMPLOYING CHANNEL AND PARALLEL ALIGNING MEMBER, FOR GABLE-TOPPED FOOD CARTONS

BACKGROUND

1. Field Of Invention

This invention relates to containers, particularly to a device for closing and sealing gable-topped cardboard containers.

2. Description Of Prior Art

The common gable-topped carton is almost universally used for packaging milk, as well as other foodstuffs, such as juices, dried goods, etc. Such containers are usually made of plasticized or waxed cardboard or homogeneous plastic sheeting. Their advantages are numerous and well-known: they are leakproof, light in weight, easy to make, easy to open, easy to hold, easy to use, easy to dispose of, and easy to close after use.

However they do have several significant disadvantages: If, after their original contents are completely decanted, one desires to re-use the carton for another purpose, such as re-using an empty milk or juice carton for holding another beverage or a pourable, particulate solid, he will find it difficult to re-seal the carton. Since the flaps have some elasticity, they will not stay closed completely upon reclosure. As a result, if a reclosed carton is accidentally tipped over, it will leak and spill. Also, the imperfect seal made upon reclosure compromises the cleanliness of the carton and allows contamination if it's exposed to solid or liquid pollutants, such as dirt, spills from above, etc. Further, the imperfect seal allows gaseous pollutants, which have odors and other deleterious aspects, to comtaminate the contents. Lastly, if the carton is re-used as a freezer container, the imperfect seal made upon reclosure will allow moisture to escape relatively rapidly by evaporation and then sublimation into the cold ambient, causing the contents to become dessicated at their surface and then at their interior, a phenomenon sometimes given the oxymoron "freezer burn".

These same disadvantages will occur if the contents of a carton are partially decanted and the carton is re-closed. E.g., if a gable carton of fresh milk is opened, used to decant some milk, reclosed, and placed in a refrigerator or cooler with odiferous foodstuffs, such as fish, the imperfect seal at the gable top upon reclosure will allow the fish odors to contaminate the milk, giving it an undesirable fishy smell.

Therefore the reader will see the need for a means of improving the reclosability and resealability of gable-topped cartons.

OBJECTS AND ADVANTAGES

Accordingly, one principal object and advantage of the invention is to provide a way to reuse and reseal gable-topped cartons. Other objects and advantages are to provide a way to reclose and reseal such cartons so as to prevent their contents from spilling or leaking if a reclosed carton is tipped over, the prevent their contents from being contaminated by solid, liquid, or vaporous pollutants, and to prevent dessication of their contents if they are used as a freezer storage container. Other objects are to provide a gable-topped carton sealer and closer, to provide one which is simple in construction, economical to make (so that it can be dispensed as an advertising giveaway or sold cheaply yet profitably), extremely easy to use, and reliable in use. Further objects and advantages will become apparent from a consideration of the ensuing description and accompanying drawings.

DRAWING FIGURES

DRAWING REFERENCE NUMERALS

| | |
|---|---|
| 10 | gable-toper carton |
| 12 | closer and sealer |
| 14 | gable side |
| 16 | gable recess |
| 18 | gable flap |
| 20 | upper, channel portion |
| 22 | lower, arm portion |
| 24 | bight portion |
| 26 | upper pressure ridge |
| 28 | lower pressure ridge |
| 30 | decorative upper outer ridge |
| 32 | decorative lower outer ridge |
| 34 | outside recessed panel |
| 36 | advertising imprint |
| 38 | chamfer surface |
| 40 | taper surface |

DETAILED DESCRIPTION—FIG. 1—DISADVANTAGES OF EXISTING CARTON

Figure 1:
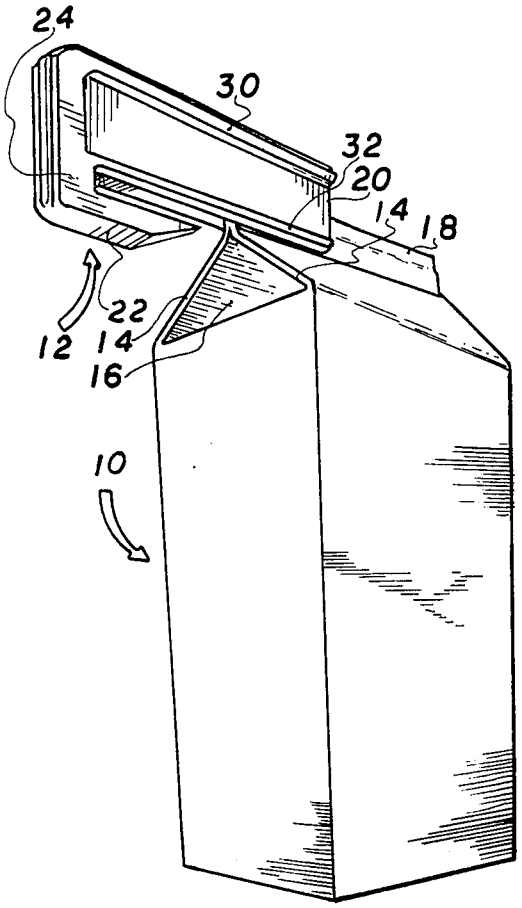
FIG. 1 is a perspective view of a gable-topped carton and closer according to the invention, the closer being used to close and seal the carton.

FIG. 1 shows a gable-topped carton 10 and a slide sealer or closer 12 according to the invention in the process of installation. Ignoring sealer 12 temporarily, note that carton has a bottom (not shown), four elongated side walls or panels, and a gable top formed by folding in the top portions of the side panels in well-known fashion. The gable top, insofar as of interest here, comprises two inwardly-sloping gable sides 14, a gable recess 16, and a multilayered vertical gable flap 18. Within recess 16 is a well-known folded-in, integral pouring spout (not shown).

To open carton 10 when it is first used, gable sides 14 are pulled apart and folded back, breaking a seal between the layers of flap 18 and causing the gable spout within recess 16 to fold out and forward for use. After the desired portion of the contents is decanted, the spout is pushed back and gable sides 14 and the separated layers of flap 18 are closed insofar as possible until the next desired use of the carton. As is well-known, when the spout is pushed back and the carton is closed, the layers of flap 18 and gable sides 4 will not close completely together due to elasticity of the cardboard material of which the carton is made. As a result, the carton will be slightly open at the top, allowing the remaining contents to leak if the carton is accidentally tipped over, and allowing contamination and/or dessication upon exposure to solid, liquid, gaseous, or thermal pollutants, as stated above.

Figure 2A:
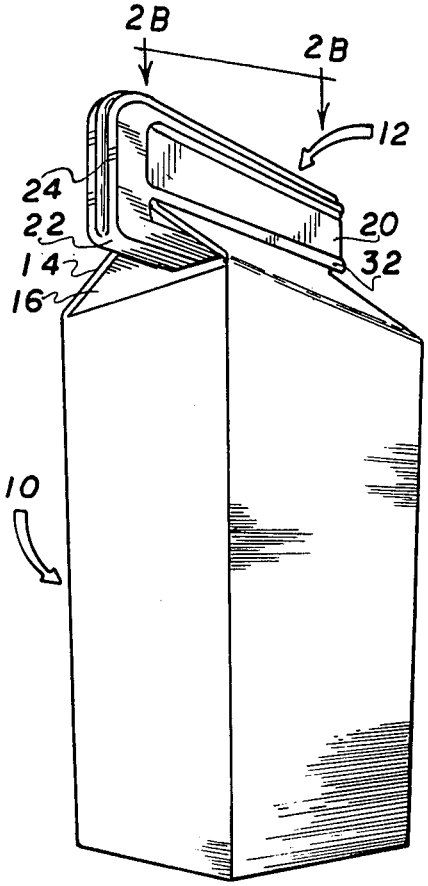
FIG. 2A is a perspective view of the gable-topped carton and closer after full installation.

If, after the entire contents are decanted, one desires to re-use carton 10 as a container for other foodstuffs or non-edible materials, she will often separate the other side of the gable top, i.e., the rear side as seen in FIGS. 1 and 2A, and bend the gable flaps so that the entire carton is completely open at its top. Then, after the interior of the carton is washed and dried, it can be re-used for other pourable contents, or for contents which can be ladled from the carton. However the same disadvantages listed above will occur, but even to a greater extent, since both sides of the carton will remain slightly open.

FIGS. 1 TO 2C—USE OF SEALER

Figure 3A:
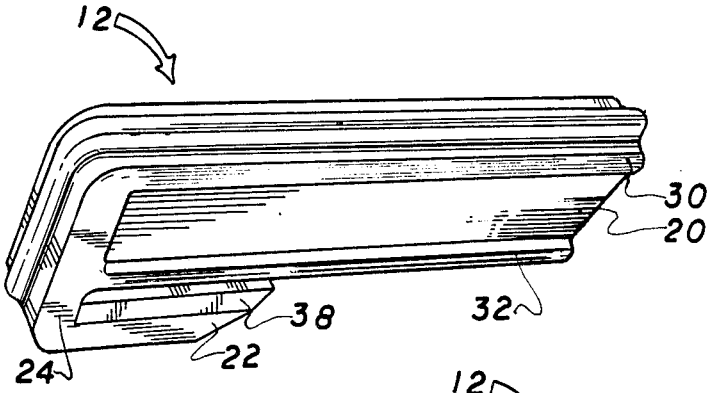
FIG. 3A is a perspective view of the closer taken from a rear angle and FIG. 3B is a perspective view taken from a front angle.
Figure 3B:
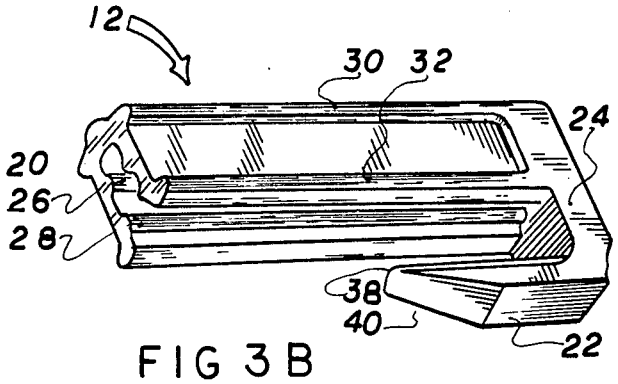
Figure 4:
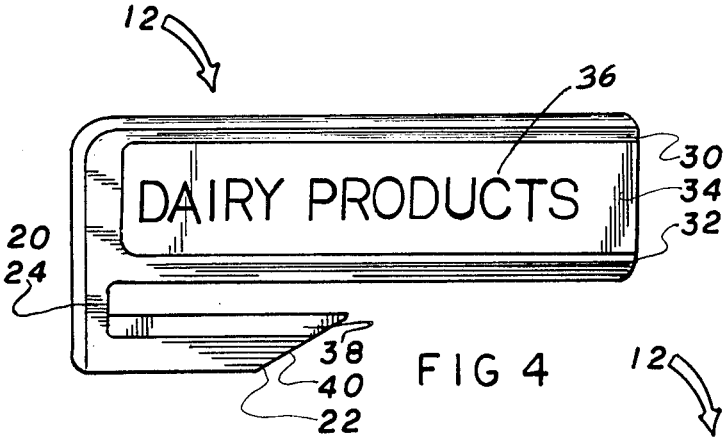
FIG. 4 is a side view of a closer with an advertising message thereon.

According to the invention, these disadvantages are overcome by the use of sealer 12. Sealer 12 is best shown in FIGS. 3 and 4 and will be described in detail later. It comprises a U-shaped upper or channel portion 20, a lower arm portion 22, and an interconnecting bight portion 24.

Figure 2B:
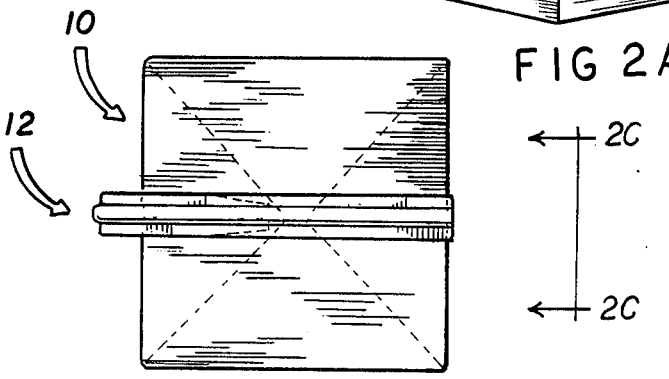
FIG. 2B is a top view taken from the direction 2B—2B in FIG. 2A.

To use the sealer to close and reseal a previously-opened carton, the spout is pushed back to form recess 16, flaps 18 are squeezed together, channel portion 12 is fit over and slided onto the the closed flaps in the direction shown by the arrow in FIG. 1. The sealer is slided as far as possible, i.e., until it assumes the position of FIGS. 2. Movement of the slider will be limited when its bight portion 24 meets the edge of flap 18. In this position, lower arm portion 22 will be positioned in gable recess 16, as shown in FIGS. 2A and 2B. Portion 22 facilitates installation, guides the positioning of the sealer onto the carton, and holds it onto the carton in parallel alignment with the top edge of the carton. I.e., as shown best in FIG. 2C, portion 22 holds channel portion 20 down onto flap 18.

FIGS. 2C, 3, AND 4—DETAILS OF SEALER

Figure 2C:
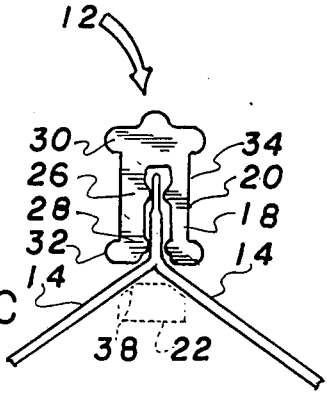
FIG. 2C is a partial side view taken along the line 2C—2C in FIG. 2B.

As shown in these Figs, channel portion 20 includes two facing sets of inner pressure ridges, i.e., two facing upper pressure ridges 26 and two facing lower pressure ridges 28. The upper ridges are spaced more closely than the lower ridges because the top portion of flap 18 is thinner than at its lower portion, as shown in FIG. 2C. This is due to the fact that the lower portion usually contains four layers of material (layers not shown) while the top portion usually contains two layers. Ridges 26 and 28 run the length of channel portion 20, as shown in FIG. 3B.

Channel portion 20 also contains, on its outside, two sets of upper and lower outer decorative ridges 30 and 32. These define a recessed panel 34 (FIG. 4) on which an advertising imprint, such as 36, can be provided. Also the sealer can be grasped and used more easily at its recessed panel.

Lower arm portion 12 is about half the length and height of channel portion 20. It contains chamfered or tapered upper edges 38 so that, upon installation, the chamfered surfaces mate face to face with the sloping inside surfaces of gable sides 14, as illustrated in FIG. 2C. The chamfers are provided on both upper sides of arm 22 and run the length of arm 22. The front lower surface of arm portion 22 includes an upwardly-tapering portion 40 so as to form a narrow front edge which can easily be inserted into gable recess 16.

The slide sealer preferably is made of a plastic, such as polycarbonate or nylon. It should be fabricated in several sizes to accommodate various sizes of cartons. Its dimensions should be in the proportions shown in relation to the carton shown. Channel portion 20 preferably is made as long as flap 18 so that it fits securely thereon and lower arm portion 22 preferably is made half the length of channel portion 20. However channel portion 20 can be made only half the length of flap 18 if only one side of the top is opened and reclosed. The spacing of inner pressure ridges 26 and 28 should be such that, upon installation, they provide enough pressure on the flaps to close all the layers thereof and thereby seal the carton. However such pressure should not be great enough to make slide installation of the sealer difficult for weak, young, or old persons, i.e., the sealer should be readily slidable on the flap.

OPERATION

As stated, the sealer is installed on a previously-opened carton by pushing in the pouring spout to form recess 16, closing gable flaps 18, as by pinching and sliding the sealer over these flaps and then home as shown in FIG. 2A. To use the carton again, the sealer is simply withdrawn in the opposite direction to that shown by the arrow in FIG. 1. Then the flaps will be free so that the carton can be re-opened in the same manner as it was originally opened.

As stated, chamfer surfaces 38 provide face-to-face contact with the inner surfaces of gable sides 14. This will cause the sealer to be and stay more precisley aligned with the carton, i.e., in parallel with its top edge, so that it will effect and maintain a good seal. Absent the chamfer, the sealer would have upper edges which would tend to dent gable sides 14, allowing the sealer have more play in relation to the carton so that its seal would tend to be less effective.

SUMMARY, RAMIFICATIONS, AND SCOPE

Accordingly it is seen that, according to the invention, a device is provided which can obviate the disadvantages of the gable-topped carton carton. It can seal an opened carton so as to enable it to be reused for other purposes and so as prevent spillage if the carton tips over and dessication by gaseous, liquid, solid, and thermal pollutants.

While the above description contains many specificities, these should not be construed as limitations on the scope of the invention, but as exemplifications of the presently-preferred embodiments thereof. Many other ramifications and variations are possible within the teachings of the invention. For example, in an economical version the bight and lower arm portions can be eliminated. The inner pressure ridges, or one pair thereof, can be eliminated. In this case the flat inner sides of the channel can be spaced to properly mate with the gable flaps. Also, the inner ridges can be replaced by several rounded pressure nubbins or bosses. The outer ridges can also be eliminated. The chamfered upper surface on the lower arm can be replaced by a regular outside corner or a rounded outside corner. Various other changes can be made within the scope of the invention. Thus the scope of the invention should be determined by the appended claims and their legal equivalents, and not by the examples given.

I claim:

1. A closer and sealer for a gable-topped carton of the type having an elongated upper flap comprising a plurality of layers which can be squeezed flat to a predetermined dimension to hold said carton closed, said sealer comprising:

an elongated channel-shaped member, the width of the channel of said member having said predetermined dimension such that said channel can be fitted over said flap to hold the layers of said flap together tightly enough to seal said carton while still allowing said channel to be slided back and forth over said flap, said channel being long enough to cover at least half the length of said flap, a lower arm portion extending parallel to said channel-shaped member, and means for limiting travel of said channel-shaped member when it is slided onto said flap from one direction, said means for limiting travel comprising a bight portion extending down from one end of said channel-shaped member and interconnecting said channel-shaped member with said lower arm portion.

2. A closer and sealer for a gable-topped carton of the type having an elongated upper flap comprising a plurality of layers having an upper edge and a gable recess under said flap and which can be squeezed flat to a predetermined dimension to hold the carton closed, said sealer comprising:

a channel-shaped member, the width of the channel of said member having said predetermined dimension such that said channel-shaped member can be fitted over said flap to hold the layers of said flap together tightly enough to seal said carton while still allowing said channel-shaped member to be slided back and forth over said flap, said channel-shaped member being long enough to cover at least half the length of said flap, and a lower arm portion parallel to and connected to said channel-shaped member, said lower arm portion having a predetermined spacing from a lower edge of said channel-shaped member so as to accommodate the dimension of said carton between the upper edge of said upper flap and the top of said gable recess.

3. The closer and sealer of claim 2 wherein said lower arm portion has upper edges which are chamfered to provide a plurality of flat surfaces which mate, face-to-face, with the underside of the upper portions of said gable recess so as to enhance alignment of said closer and sealer with said carton.

4. The closer and sealer of claim 2, further including a bight portion interconnecting said lower arm portion with said channel-shaped member, said bight portion being joined to one end of said channel-shaped member and one end of said lower arm portion.

5. A closer and sealer for a gable-topped carton of the type having an elongated upper flap having a predetermined height and a gable recess thereunder and comprising a plurality of layers which can be squeezed flat to a predetermined dimension to hold said carton closed, said sealer comprising:

a channel-shaped member, the width of the channel of said member having said predetermined dimension such that said channel-shaped member can be fitted over said flap to hold the layers of said flap together tightly enough to seal said carton while still allowing said channel-shaped member to be slided back and forth over said flap, said channel-shaped member being long enough to cover at least half the length of said flap, a lower arm portion parallel to and connected to said channel-shaped member, said lower arm portion having a predetermined spacing from a lower edge of said channel-shaped member so as to accommodate the height of said elongated upper flap when said lower arm portion is inserted into said gable recess, and a bight portion interconnecting said lower arm portion with said channel-shaped member, said bight portion being joined to one end of said channel-shaped member and one end of said lower arm portion.

6. The closer and sealer of claim 5, further including at least one pair of facing pressure ridges on the inside of said channel-shaped member, said ridges extending parallel to said channel-shaped member and having said predetermined spacing therebetween such that when said channel-shaped member is fitted over said flap, said ridges will hold the layers of said flap together tightly enough to seal said carton while still allowing said channel-shaped member to be slided back and forth over said flap.

7. The closer and sealer of claim 6, further including a second pair of pressure ridges on the inside of said channel-shaped member, said second pair of ridges being parallel to said first pair and spaced therefrom, said second pair of ridges having a predetermined spacing therebetween such that when said channel-shaped member is fitted over said flap, both pairs of said ridges will cooperate in holding the layers of said flap together tightly enough to seal said carton while still allowing said channel-shaped member to be slided back and forth over said flap.

8. The closer and sealer of claim 7 wherein said first pair of ridges has a narrower spacing than said second pair so that said both pair of ridges will mate with a flap having a thinner portion and a thicker portion.

9. The closer and sealer of claim 8 wherein said first pair of ridges is adjacent the base of said channel-shaped member and said second pair is adjacent the opening of said channel-shaped member.

10. The closer and sealer of claim 9 wherein said channel-shaped member has advertising imprinted thereon.

11. The closer and sealer of claim 10 wherein the upper edges of said lower arm portion are chamfered to provide a plurality of flat surfaces which mate, face-to-face, with the underside of the upper portions of said gable recess.

* * * * *